US007456702B2

(12) United States Patent
Keefe et al.

(10) Patent No.: US 7,456,702 B2
(45) Date of Patent: Nov. 25, 2008

(54) LOW PASS METAL POWDER FILTER

(75) Inventors: George Andrew Keefe, Cortlandt Manor, NY (US); Roger Hilsen Koch, Amawalk, NY (US); Frank P Milliken, Jr., Tarrytown, NY (US); James R. Rozen, Peekskill, NY (US)

(73) Assignee: International Business Machines Corporation, Armonk, NY (US)

( * ) Notice: Subject to any disclaimer, the term of this patent is extended or adjusted under 35 U.S.C. 154(b) by 270 days.

(21) Appl. No.: 11/456,351

(22) Filed: Jul. 10, 2006

(65) Prior Publication Data

US 2008/0258849 A1 Oct. 23, 2008

(51) Int. Cl.
*H01P 1/04* (2006.01)
*H01P 1/213* (2006.01)

(52) U.S. Cl. ..... 333/99 S; 333/206; 439/578

(58) Field of Classification Search ..... 333/99 S, 333/182, 202, 206; 439/581, 578
See application file for complete search history.

(56) References Cited

U.S. PATENT DOCUMENTS 5,367,956 A * 11/1994 Fogle, Jr. ..... 102/202.2

* cited by examiner

*Primary Examiner*—Daniel D Chang
(74) *Attorney, Agent, or Firm*—Whitham, Curtis, Christofferson & Cook, PC; Stephen C. Kaufman

(57) ABSTRACT

A low pass filter having a coaxial structure of an inner conductor, an outer conductor and a metal powder composite interposed between the inner and outer conductor. Embodiments include a 50Ω characteristic impedance. The metal powder can be bronze, copper or other metals, mixed in an epoxy carrier.

14 Claims, 6 Drawing Sheets

LOW PASS METAL POWDER FILTER

This invention was made with Government support under Contract No.: MDA972-01-C-0052 awarded by Defense Advanced Research Projects Agency (DARPA). The Government may have certain rights in this invention.

BACKGROUND OF THE INVENTION

1. Field of the Invention

The present invention relates generally to filters that selectively pass and attenuate electromagnetic waves and, more particularly, to low pass filters for attenuating high frequency electromagnetic signals.

2. Description of the Prior Art

Various structures commonly known as "filters" are used for suppressing or attenuating, to a desired specification, electromagnetic waves impinging on and propagating through the filter, depending on the signal's or wave's constituent frequencies. The number and scope of fields of communication, entertainment, and industrial equipments and systems requiring electronic filters is essentially indefinable. Therefore, it will be understood that the example applications for the filter described herein are not limiting; the fields are presented to assist the person of ordinary skill better understand the present filter, and to make and use a filter in accordance with described herein, for either an application similar to the example application, or any other of a wide range of applications.

Textbooks, technical journals, and other publications embody a large knowledge base of filters, including their types, structures, guidelines for selection, methods of design, construction, and testing. Within this large existing knowledge base, it is also well known that problems exist in designing and constructing a "low pass" filter, i.e., a filter that attenuates electrical signals above a "cut-off" frequency while, at very high frequencies, both maintaining a given characteristic impedance and adequate attenuation. It is also known that problems exist in designing and/or constructing a filter that meets such impedance and attenuation criteria while operating at very low temperatures.

Stated in reference to particular example requirement, in the existing art of electronic filters it is difficult to construct a low pass filter that can operate at temperatures such as, for example, 4 degrees Kelvin, provide a characteristic impedance of, for example, 50Ω, and provide, for example, −80 dB of attenuation for frequencies above a cutoff frequency of, for example, 100 MHz, while maintaining that attenuation for signals having components over, for example 5-10 GHz.

For purposes of this description, the terms "signal" and "electrical signal" will mean, unless otherwise clear from the context, any electromagnetic energy propagating through, or coupling between, any medium or structure, regardless of informational content in the signal. In other words, the phrases "signal" and "electrical signal" include electromagnetic energy that, for the intended purposes of the invention, are noise, including white noise, or other energy that the filter is intended to attenuate, i.e., not pass.

Further, the phrase "characteristic impedance" is very well known in the electronic filter art and, therefore, further description is omitted except where it is helpful for an understanding of this invention.

An example that reveals certain shortcomings in the prior art of electronic filters is presented by systems and equipment used in research, development and, eventually, manufacture of quantum computers. The present invention is not directed to quantum computing per se. The present invention is a novel method and apparatus for low pass filtering that, in addition to other likely benefits, has very good high frequency attenuation, can be easily built to meet impedance matching requirements, and maintains these attenuation and impedance characteristics at low temperatures. Present and anticipated future quantum computing machines are one, but not the only, system that would benefit from such a filter. However, it is not necessary to describe the theory of quantum computing theory in order to enable construction of a working embodiment of, or to otherwise practice, the invention. Quantum computing methods, equipment and systems are described only where necessary to better understand the example filters described herein, and to assist the user in selecting dimensions, materials and arrangements that fit the user's particular requirements.

In the example field of quantum computing, it is known that decoherence in superconducting qubits is often caused by high frequency noise transmitted along electrical leads connecting the qubit to measurement electronics at room temperature. The term "qubit" is known in the art quantum computing and further description is omitted, as it is not necessary for understanding this invention. One kind of noise comes directly from the measurement electronics at room temperature. In this case the filter can be located anywhere between the measurement electronics and the qubit. The second type of noise is Johnson ("white") noise that is produced by resistive elements in the electrical connections between the room temperature electronics and the qubit. The location of these resistive elements will usually determine where one or more filters need to be thermally well grounded at one or more carefully chosen temperatures. For purposes of this description, the phrase "thermally well grounded" means a temperature difference of less than approximately 10%, using cooling and connection methods that are well known in the art of low temperature technology.

As an illustrative example of such temperatures, a qubit can be measured in a dilution refrigerator, which attains a typical minimum temperature of about 20 millidegrees Kelvin ("mK"), measured at the mixing chamber within a vacuum can that is immersed in liquid He4, itself at a temperature of 4.2 degrees Kelvin. Before reaching the qubit, all electrical wiring is preferably thermally grounded at, for example, approximately 4.2° K, 1.3° K, 0.7° K, and 0.1° K. These are example temperatures of operating parts of the dilution refrigerator that can handle a sizeable heatload, i.e., the electrical wiring, at that temperature.

There are known methods and structures directed to filtering unwanted noise having frequencies above, for example, 1 MHz at low temperatures. All have shortcomings either in terms of impedance or frequency characteristics. One example is a miniature thin film filter as reported by Vion et al., J. Appl. Phys. 77, 2519 (1995). Another example is a distributed thin film microwave filter reported by Jin et al., Appl. Phys. Lett. 70, 2186 (1997). Still another example is the Philips Thermocoax filter, as discussed in A. Zorin, Rev. Sci. Instrum. 66, 4296 (1995). In most cases these filters were first used to reduce noise in single electron tunneling experiments. Perhaps the simplest and easiest to fabricate "microwave" filter is the bulky metal powder filter. The metal powder filter was first discussed in more detail by Martinis et al., Phys. Rev. B 35, 4682 (1987) and subsequently developed and discussed in detail by others. See K. Bladh et al., Rev. Sci. Instrum. 74, 1323 (2003), and A. Fukushima et al., IEEE Trans. Instrum. Meas. 45, 289 (1997).

The metal powder filters known in the relevant art have a central conductor that is surrounded by metal powder or a metal powder/epoxy mixture. The filter attenuates an incoming electrical signal via eddy current dissipation in the metal powder. The known art teaches, however, that the central conductor is shaped into the form of a spiral to increase the attenuation. This does indeed increase the attenuation but, as observed by the present inventors, these spiral conductor metal powder filters cannot be designed to have a characteristic impedance near 50Ω at high frequencies. The present inventors have identified that such filters cannot provide a 50Ω impedance at high frequencies because each adjoining loop of the spiral is capacitively coupled to the next loop, and if the spiral is "tight" then at high frequency this coupling looks like a short between loops. Stated differently, the physical design of known metal powder low pass filters creates what is technically a short at high frequencies, not 50 ohms.

In many high frequency applications, however, it is necessary to have an all matched 50Ω impedance measurement setup. If low pass filters are used they also must be 50Ω. The known metal powder filters cannot, because of their spiral form, meet this requirement.

SUMMARY OF THE INVENTION

It is therefore an object of the invention to provide a method and apparatus for attenuating high frequency signals while maintaining a desired characteristic impedance.

It is a further objective of the invention to provide a method and apparatus that passes signals of a frequency below a given cut-off frequency, attenuates signals above that cut-off frequency, and maintains the attenuation up to a very high frequency.

It is a further objective of the invention to provide a method and apparatus that provides a desired characteristic impedance, passes signals of a frequency below a given cut-off frequency, attenuates signals above that cut-off frequency, and maintains the attenuation and the desired characteristic impedance up to a very high frequency.

It is a further objective of the invention to provide a method and apparatus that provides a desired characteristic impedance, passes signals of a frequency below a given cut-off frequency, attenuates signals above that cut-off frequency, and maintains the attenuation and the desired characteristic impedance up to a very high frequency, and over a very wide temperature range.

It is a further objective of the invention to provide an easy-to-manufacture filter structure that provides a desired characteristic impedance, passes signals of a frequency below a given cut-off frequency, attenuates signals above that cut-off frequency, and maintains the attenuation and the desired characteristic impedance up to a very high frequency.

It is a further objective of the invention to provide an easy-to-manufacture filter structure that provides a desired characteristic impedance, passes signals of a frequency below a given cut-off frequency, attenuates signals above that cut-off frequency, and maintains the attenuation and the desired characteristic impedance up to a very high frequency, over a very wide temperature range.

It is a further objective of the invention to provide an easy-to-manufacture filter structure that provides a 50Ω characteristic impedance, passes signals of a frequency below a given cut-off frequency, attenuates signals above that cut-off frequency, and maintains the attenuation and the desired characteristic impedance up to a very high frequency, at temperatures down to approximately 4 degrees Kelvin.

The foregoing and other features and advantages of the present invention will be apparent from the following description of the preferred embodiments of the invention, which is further illustrated in the accompanying drawings.

BRIEF DESCRIPTION OF THE DRAWINGS

The subject matter of the present invention is particularly pointed out and distinctly claimed in the claims appended to this specification. The subject matter, features and advantages of the invention will be apparent from the following detailed description viewed together with the accompanying drawings, in which:

DETAILED DESCRIPTION

Figure 1:
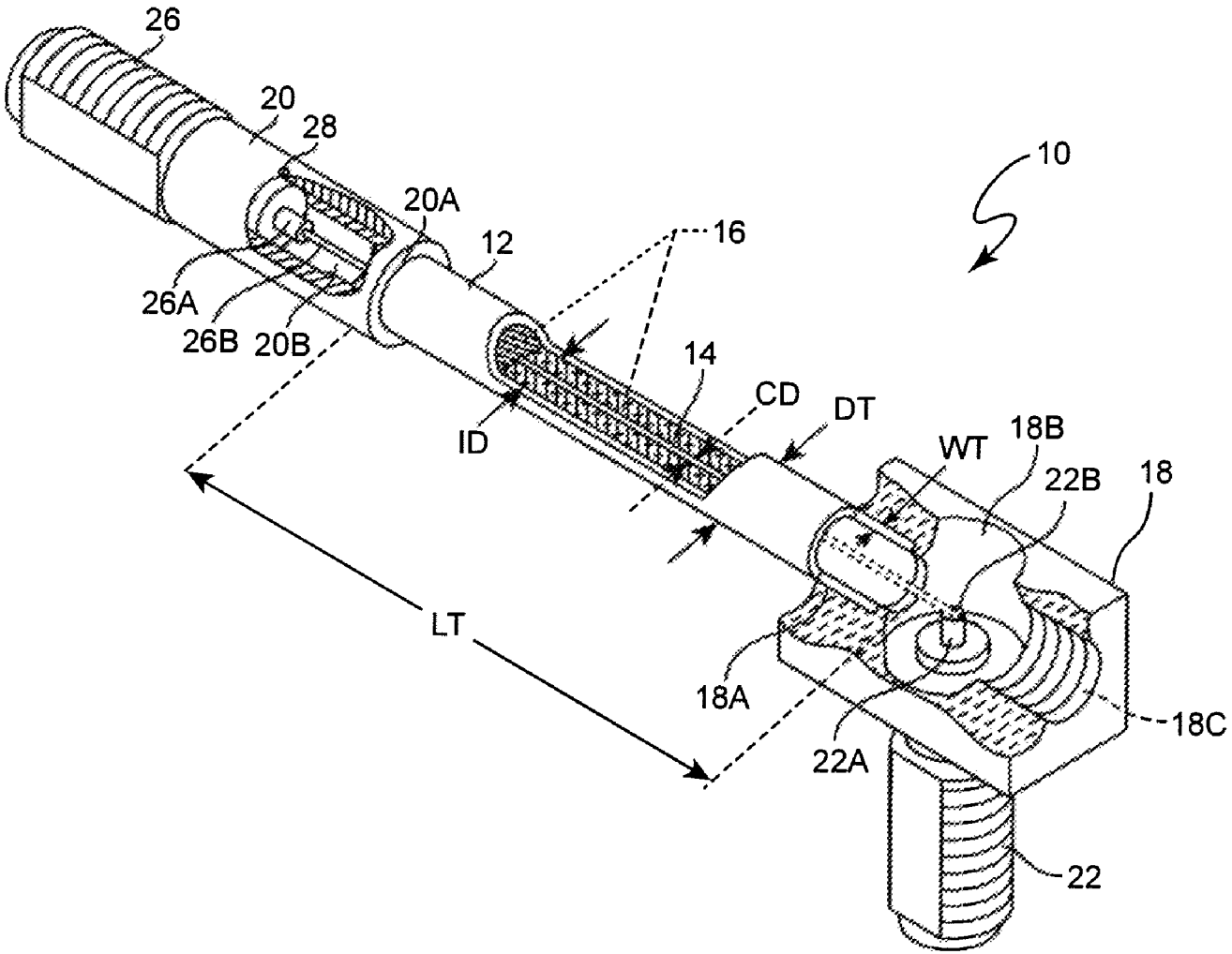
FIG. 1 is a partial cut-away perspective view of an example filter according to the described invention.

FIG. 1 shows a partially cut-away perspective view of an example filter 10 according to the present invention. The example filter 10 includes an outer tube 12, a center conductor 14, and a metal powder/binder filler 16 which may be, as described in further detail below, particularly formulated metal powder/epoxy mixture. The particular example filter 10 further includes a connector block 18 attached to one end of the outer tube 12, and a connector adaptor 20 attached to the other end of the outer tube 12. The outer tube 12 is a metallic conductor. Example metals suitable for the outer conductor 12 include brass. The outer tube 12 has a length LT, an outer diameter DT, an inner diameter ID, and a wall thickness WT. The center conductor 14 has a diameter CD.

The value of the center conductor 14 diameter CD and the outer tube 12 inner diameter ID are dictated in part by the following well-known equation governing the characteristic impedance of a coaxial line:

$$Z = \frac{138}{K^{1/2}} \log(b/a), \qquad \text{(Equation No. 1)}$$

where K is the effective dielectric constant of the material surrounding the inner conductor, i.e., the material 16, the variable a is the diameter of the inner conductor, i.e., the diameter CD of the center conductor 14, and variable b is the inside diameter of the outer conductor, i.e., the inner diameter ID of the outer conducting tube 12. Since there are three variables, i.e., the CD and ID dimensions and the K effective dielectric constant, the solutions to Equation No. 1 that will provide a given impedance are, at least mathematically, infinite. As will be understood from this description, though, there are certain guidelines for selecting a starting point. For example, the universe of achievable values of K is limited by the binder component of the mixture 16 having to meet certain thermal and viscosity requirements, and by the percentage of metal powder. Also, because, as will be understood upon reading this description, the attenuation mechanism of the filter according to this invention is by losing energy to the metal powder in the mixture 16. The present inventors have identified that the more metal powder close to the center conductor 14 the more energy loss. Therefore, the higher the percentage of metal powder in the mixture 16 the greater the attenuation. The target value of K is therefore selected in view of what is achievable when using the necessary percentage of metal powder in the metal powder/binder mixture 16. The selection of the center conductor 14 wire diameter CD will be driven, at least in part, by the ease of working with the wire. Once K is fixed, fixing CD fixes the outer tube's inner diameter ID. Therefore, it is seen that the choice of CD and ID preferably incorporates the relevant needs of the application.

For example, the present inventors constructed filters using a 0.005 inch diameter wire for the center conductor 14 which, in view of a 50Ω impedance, required the outer tube 12 to have an inner diameter ID of about 0.125 inches. This ID value was practical with respect to the scale/size filters that the inventors needed for the example qubit measurement application. It is conceivable, though, that a larger CD and larger ID may result in a structure better able to withstand thermal stresses without fracture. Stated with greater particularity, it is probable when a filter having larger ID and CD values is exposed to low temperature that the metal powder/epoxy mixture 16 may fracture, but this may not cause an unacceptable failure of the filter such as, for example, the center conductor 14 fracturing.

The connector block 18 of the FIG. 1 example has a tube receiving bore 18A, dimensioned to receive and support the outer tube 12. The specific dimension of the bore 18A is a design choice, but guidelines include alignment and sufficient spacing to allow solder or other adhering materials to flow. An example, assuming solder being used to secure the outer tube 12 into the bore 18A, is a bore diameter approximately 0.001 in. larger than the tube outer diameter DT, with a tolerance of, for example, plus approximately 0.001 inches.

The connector block 18 of this example has a connector receiving bore 18B, extending perpendicular to 18A, dimensioned to accept a first connector 22. An example first connector 22 is a commercially available SSMA type. These are well known in the art and, therefore, further discussion is omitted. This is not, however, the only type of acceptable connector 22. The specific connector is a design choice, driven by the specific characteristic impedance and frequency characteristic desired for the filter, and readily made by a person skilled in the art upon reading this description. For example, the first connector 22 could be a commercially available SMA type, also well known in the art, but which generally possesses high frequency performance inferior to the SSMA type.

With continuing reference to FIG. 1, the connector block 18 of the depicted example filter 10 has a first clearance hole 18B, formed to allow a soldering operation (not specifically depicted) to secure and connect the center conductor 14 to the top surface 22B of the inner conductor 22A of the example SSMA connector 22.

The connector block 18 of the FIG. 1 example further includes a second clearance hole 18C, which serves two functions.

The first function of the second clearance hole 18C in the FIG. 1 example is to permit the center conductor 14, at an intermediate stage of assembling, to extend through the hole 18C, with enough conductor 14 protruding to grip with an apparatus, such as pliers (not shown) to pull the center conductor 14, after being soldered to the center conductor 26A of the second connector 26, as it is being soldered to the center conductor 22B of the first connector 22. As described in greater detail below, these soldering and pulling operations are performed prior to the center conduct 14 being supported by the metal powder/binder filler 16.

The second function of the second clearance hole 18C in the FIG. 1 example is for injecting the viscous form of the metal powder/binder filler 16, as will be described in further detail below.

Referring again to FIG. 1, the example connector adaptor 20 is a simple sleeve bushing, having at its right end an outer tube receiving bore 20A dimensioned to receive the outer tube 12 and, at its left end, a connector receiving bore (not specifically shown) formed to receive a second connector 26. The second connector 26 may, for example, be a commercially available SSMA connector and may be structurally identical to the first connector 22.

A small vent hole 28 is formed in the connector adaptor 20, to enable injection of the viscous form of the metal powder/binder mixture 16, via the second clearance hole 18C formed in the connector block 18. As will be better understood by reading the description below of an example assembly operation, the small vent hole 28 enables injection of the viscous form of the mixture 16 by functioning as an air vent, thereby permitting the mixture 16, while still viscous, to flow into the second clearance hole 18C, and fill the space between the center conductor 14 and the outer tube 12—all the way from the hole 18C to the end surface 26A of the second connector 26, and including the chamber volume labeled as 20B.

Still referring to FIG. 1, the center conductor 14 has a diameter CD and, for a very low temperature application such as qubit measurement, is preferably formed of a superconducting wire. For low temperature applications, the center conductor 14 is preferably a superconducting material to limit the amount of heat that conducts along conductor 14. Superconducting wire provides this benefit because once such wire is below its superconducting temperature, Tc, its ability to transmit heat from one end to the other is greatly reduced. The underlying reason is that there are two main ways to conduct heat—transport of electrons and phonons. Below Tc there are no entropy carrying electrons since they are all superconducting pairs. That leaves phonons, which exponentially decrease in number as temperatures go well below Tc.

The present invention, when employing superconducting wire as the center conductor 14, exploits this characteristic of the wire in a manner directly beneficial to, for example, qubit measurements. It is directly beneficial because in qubit measurements it is important to minimize the amount of heat transported directly along electrical wiring, since they are directly connected to the sample holder that contains the qubit being measured. Filters, or attenuators, even according to the present invention, are resistive elements and therefore generate heat. Even though these attenuators are heat sunk, some heat is still transported along the wire to regions at lower temperatures. Using superconducting wire for the center conductor 14 is a way of blocking this heat.

Further, the present inventors have identified that replacing the inner conductor of even conventional filters with a superconducting wire would obtain at least this heat blocking benefit, although without the impedance and attenuation benefits provided by the FIG. 1 filter of this description.

Further, for applications of the present invention not requiring low temperature operation, a standard non-superconducting wire could be used for the center conductor 14.

An example material for the center conductor 14 is Cu-clad NbTi superconducting wire. Commercially available examples of such Cu-clad NbTi wire will sometimes have an insulation coating of polyvinyl such as, for example, the polyvinyl very well known and commonly referenced in the relevant arts by the trademarks Formvar™ and Vinylec™. Typical thickness of such insulation, for a wire of having a diameter CD of 0.005 inches, is about 0.001 inches. The present inventors determined that such insulation is acceptable, at least for the example filter characteristics specifically identified by this specification. However, a center conductor 14 consisting of a wire without such insulation may be preferable as it may provide better filter damping.

Referring to FIG. 1, the metal powder/binder mixture 16 will now be described.

The make-up of the metal powder/binder mixture 16 is critical, because it controls the filter attenuation characteristics, and determines the value of K in Equation No. 1 of this disclosure, repeated below, which is the well-known equation governing the characteristic impedance of a coaxial line:

$$Z = \frac{138}{K^{1/2}} \log(b/a), \qquad \text{(Equation No. 1)}$$

where K is the effective dielectric constant of the material 16, the variable a is the diameter CD of the center conductor 14, and variable b is the inner diameter ID of the outer conducting tube 12. The material 16 must meet other criteria as well, such as, for example, thermal conductivity, coefficient of thermal expansion, and the ability to hold a sufficient percentage of metal powder in suspension with sufficiently low viscosity to permit injection into the space between the center conductor 14 and the inner surface of the outer tube 12, as will be described in greater detail below.

Preferred constituent materials of the mixture 16 are metal powder and a binder, which may be, for example, epoxy. Binders other than epoxy may be used, but selection must be made in view of the required dielectric constant, the materials from which the center conductor 14 and outer tube 12 are formed, respectively, and the environment in which the filter is intended to operate. For example, if the filter is intended to operate at extremely low temperatures, then the binder component of the metal powder/binder mixture must have thermal characteristics compatible with those of center conductor 14 and outer tube 12, such that stresses are not built up that may fracture the center conductor 14. This will be understood upon reading the present disclosure in its entirety, including the description of specific examples constructed by the present inventors.

Example metal powders include powdered copper and powdered bronze. Powdered copper and powdered bronze oxidize naturally and, therefore, are insulating at DC. The average size of the metal powder particles and the statistical distribution of the particle size determine the cutoff frequency Fc and attenuation characteristic of the filter. Stated with more specificity, the smaller the particle size, the higher the cutoff frequency Fc. The choice of metal, and the particle size and the statistical distribution of the particle size also affect the effective dielectric constant K of the metal powder/binder 16, as described above in reference to Equation No. 1.

Referring again to Equation No. 1, it is seen that upon fixing K at a particular value, the impedance of the filter 10 is entirely determined by two structural parameters of the filter—the inner diameter ID of the tube 12 and the outer diameter CD of the center conductor 14. However, K may not always be picked at random; it should be selected in view of the necessary percentage of metal powder in the mixture 16, the diameter statistics of the particles in the metal powder, the dielectric properties of the binder components of the mixture 16, as well as in consideration of the available dimensions of commercial materials, such as wire and tubing, for making the center conductor 14 and outer tube 12, respectively.

It should be understood that the actual K of the metal powder/binder 16 may differ from the target K value—the value on which the dimensions CD and IC of center conductor 14 and outer tube 12 were selected. Such variances can arise, for example, from manufacturing variances in the epoxy or other binders used in the metal powder/binder 16. The difference between the actual and target K value will likely result in the filter not having the desired characteristic impedance. The solutions are straightforward. One, as described below, is to remake the filter with an outer tube 12 having a different inner diameter ID. Another is to fine tune the relative percentage of the constituent materials of the metal powder/binder 16, and remake the filter. As stated above, though it is preferable to begin with as high a percentage of metal powder as possible, i.e., the highest percentage at which the liquid form of the mixture 16 can be injected, as described below, because the high percentage maximizes the attenuation. Then, if Z is off, one should adjust IC of the outer tube 12, if possible, rather than fine tune the percentage of metal powder in the mixture 16, because the percentage may already be near the maximum for which the mixture can be injected and, therefore cannot be increased, and decreasing the percentage will adversely affect attenuation.

The powders are preferably free of ferromagnetic impurities, which could be a source of noise. Methods of testing from such impurities are known in the art and need not be described but, for purposes of example, testing can be done using a Quantum Design SQUID based magnetic susceptometer. Commercially available products can be used, including (i) an approximately 1-5 μm Cu powder available from Aremco™ Products, (ii) an approximately 37 μm Cu powder, and (iii) an approximately 3 μm bronze powder (30% Sn, 70% Cu) available from Kennametal™.

Figure 2:
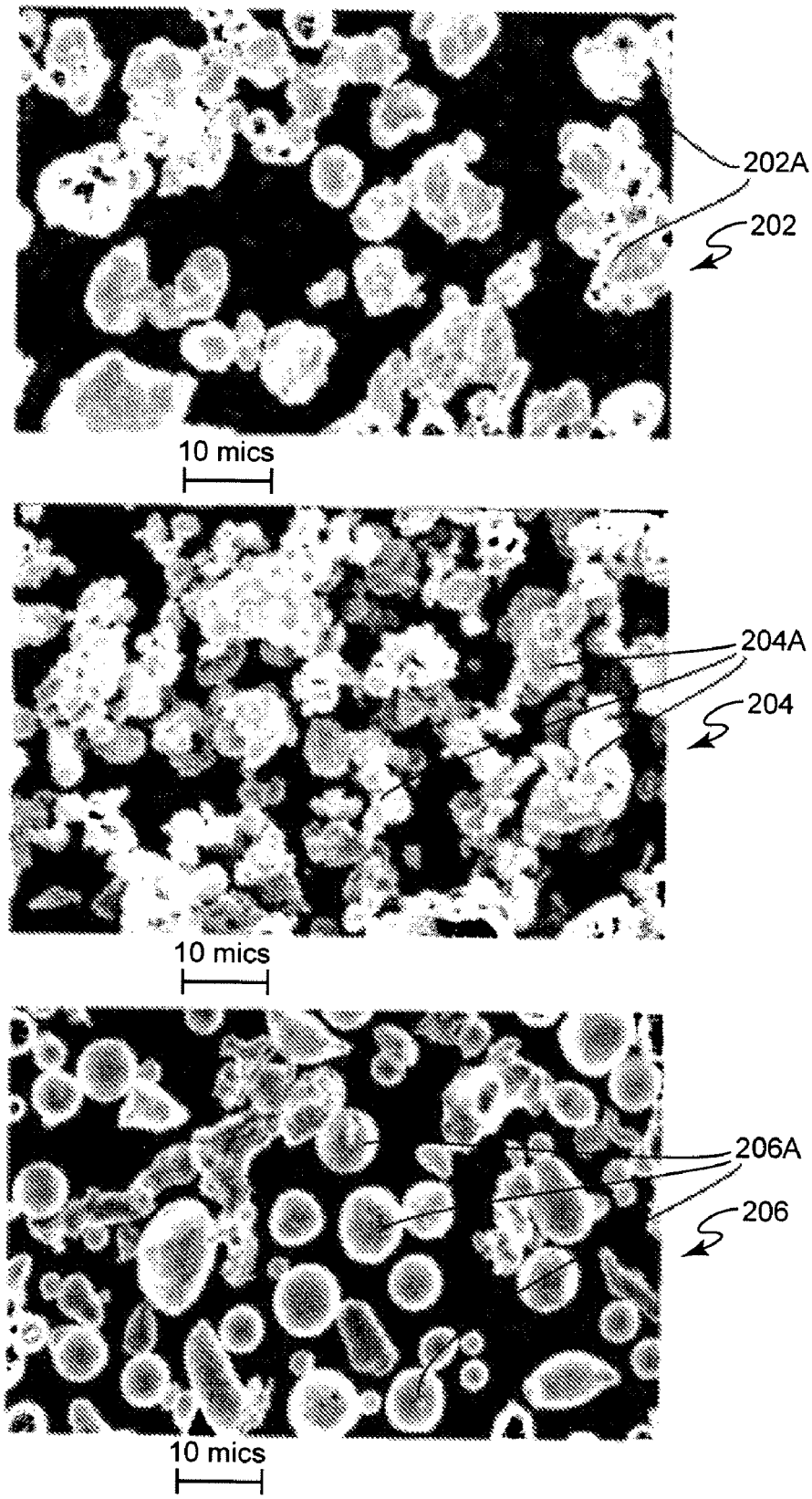
FIG. 2 is a scanning electron microscope ("SEM") image of three example powdered metal constituents of example embodiments of filters according to the invention.

In view of the inventors' presently formed theory of operation of this invention, which is described in further detail below, it is generally suggested to inspect the actual particle size(s) and/or statistical distribution of particle sizes in the metal powder before mixing it to form the filler 16, regardless of it being obtained from a commercial vendor. For example, FIG. 2 shows scanning electron microscope ("SEM") images, labeled 202, 204 and 206, corresponding to the three above-identified example powders that the present inventors obtained from commercial vendors. Image 202 is an SEM of the approximately 1-5 μm Cu powder obtained from Aremco™ Products, image 204 is an SEM of the approximately 37 μm Cu powder obtained from Kennametal™, and image 206 is an SEM of the approximately 3 μm bronze powder (30% Sn, 70% Cu) obtained from Kennametal™.

Referring to FIG. 2, the bronze powder shown in image 206 is mostly spherical and the distribution of particle sizes is relatively narrow. This is clear from the 10 μm reference unit, labeled "10 MICS," appearing on each of the images 202, 204 and 206. Each of the images has its particles labeled 202A, 204A and 206A, respectively. Also, it is seen, at least for the specific samples reflected by image 202 of FIG. 2, that the average size of the Aremco™ Cu particles 202A, although packaged as being approximately 1-5 μm, was actually as large as, if not larger than, the Kennametal™ Cu particles 206A, which were packaged as being approximately 37 μm Cu. These observed particle diameter statistics are relevant, and should be borne in mind in practicing the invention based on commercially available metal powder, because particle diameter affects the dielectric constant K, the cut-off frequency fc and, because the basic loss mechanism of the filters of this invention is the eddy current dissipation in the metal particles, the attenuation.

Referring to FIG. 1, example compositions of the metal powder/binder mixture 16 include a mixture of epoxy and metal powder. An illustrative example of an epoxy suitable for this invention is a mixture of a thermally conductive epoxy, preferably formulated for encapsulating particles, e.g. metal powder, a catalyst for the thermally conductive encapsulating epoxy, and a low viscosity epoxy for controlling the viscosity of the liquid preset mixture 16. The relative percentages of these constituent materials is selected to obtain a desired viscosity of the completely mixed, but pre-set mixture 16, and a desired dielectric constant and set of thermal properties of the mixture after being injected into the space between the center conductor 14 and the outer tube 12, and setting, as will be understood from this description.

With respect to the thermally conductive encapsulating epoxy component of the mixture 16, acceptable specifications are, for example, a mixture of approximately 20-35% (weight concentration) epoxy resin, 1-5% butyl glycidyl ether, and less that 0.5% carbon black having, prior to mixing with the catalyst, a density of approximately 2.35-2.45 grams per cubic centimeter, and a Brooksfield viscosity, using test method ASTM-D-2393, 5 rpm, #7, of 200-250 Pa·s, and 200,000-250,000 cP. After mixing with a catalyst as described below, the thermally conductive epoxy can have a set time ranging from approximately one to four hours at 65 degrees Celsius to 16-24 hours at 25 degrees Celsius. After setting, acceptable relevant specifications are $\alpha^1$ and $\alpha^2$ coefficients of thermal expansion, according to the ASTM-D-3386 test, of $\alpha^1$ ranging from approximately 31 to approximately 36 and $\alpha^2$ ranging from approximately 98 to approximately 112 (where $\alpha^1$ and $\alpha^2$ are in the ASTM-D-3386 units of $10^{-6}$/° C.), a thermal conductivity, according to the ASTM-D-2214 test, ranging from approximately 1 to approximately 1.3 Watt/m K and from approximately 7 to approximately 9 Btu-in/hr-ft$^2$-° F., and a dielectric constant, under the ASTM-D-150 test, ranging from approximately 5 to approximately 5.4. An example commercially available thermally conductive epoxy meeting these specifications is "Stycast™ 2850 FT" available from Emerson and Cuming™ and/or the National Starch & Chemical™ Company.

With respect to the catalyst for the above-identified thermally conductive encapsulating epoxy, the specification may, for example, be as follows: an aromatic amine such as 4,7, 10-trioxytridecane-1,13diamine. An example commercially available catalyst that meets these specifications is "CATALYST 24LV," available from Emerson and Cuming™ and/or the National Starch & Chemical™ Company. The mixture ratio of the example thermally conductive encapsulating epoxy and the example catalyst is approximately 7.5 parts catalyst per 100 parts epoxy by weight, or 17.5 parts catalyst per 100 parts epoxy by volume.

With respect to the low viscosity epoxy for controlling the viscosity of the liquid form of the mixture, an example of acceptable specification is as follows: a mixture of amine and epoxy, with approximately 28 parts amine per 100 parts epoxy by weight, or 33 parts amine per 100 parts epoxy by volume. Mixed in these proportions, an example acceptable working life for the low viscosity epoxy is approximately 30 minutes to two hours, with "working life" defined in accordance with ERF 13-70. An acceptable density is, for example, approximately 1.12 grams per cubic centimeter, and an acceptable Brookfield viscosity is, for example, 0.65 Pa·s and 650 cP, as defined by the ASTM-D-2393 standard. An acceptable cure time, at 65 degrees Celsius is, for example, approximately 2-4 hours and, at 25 degrees Celsius is, for example, approximately 8-16 hours. Upon curing, the value 3 is an example acceptable dielectric constant for this low-viscosity component, using the ASTM-D-150 standard at 60 Hz. An example commercially available low viscosity encapsulating epoxy meeting these specifications is "Stycast™ 1266 A/B" available from Emerson and Cuming™ and/or the National Starch & Chemical Company.

To lessen repetition in this description, the above-described "Stycast™ 2850 FT" thermally conductive encapsulating epoxy, and its catalyst, "CATALYST 24LV" are hereinafter referenced collectively as "2850 thermally conductive epoxy," or simply "2850 FT." Likewise, the above-described "Stycast™ 1266 A/B" low viscosity epoxy will be referenced as "1266 low viscosity epoxy" or simply "1266 A/B." It will be understood that the labels "2850 FT" and "1266 do not limit the invention to using the identified example vendors, or the identified examples of specific products. Instead, even for the below-described examples of the filter 10, "2850 FT" and "1266 A/B" encompass the particular identified vendors' products, as well as any other epoxies or binders substantially meeting the above-identified example specifications that "2850 FT" and "1266 A/B" meet, and all equivalents thereto.

For the example epoxy mixture of "2850 FT" and "1266 A/B" the mixing proportion may be 80% "2850 FT" and 20% "1266 A/B." The function of the example type "1266 A/B" was to lower the viscosity of the mixture, and thereby enable injection of mixture 16 having a higher metal powder content. Stated differently, a viscosity-lowering ingredient, such as "1266 A/B," generally allows a higher percentage of metal powder to be mixed in before the mixture 16 becomes too viscous to inject into a filter, such as the example 10 of FIG. 1. An observed maximum percentage of metal powder, by weight, that could be mixed and remain capable of being injected, is about 80%.

It should be understood, when choosing the binder for the mixture 16 for a filter of the present invention to be used at very low temperatures, that the metal powder of the mixture 16 must be sufficiently mixed with the binder, such as epoxy, such that the metal powder component of the mixture 16 and the center conductor 14 are well thermalized. Stated differently, a filter according to the invention made with a mixture 16 having no binder, i.e., by simply packing metal powder into the space between the center conductor 14 and the outer tube 12, would not likely perform adequately. Illustrating this by example, if the center conductor 14 has a transition temperature of 9.3 degrees Kelvin then the center conductor 14 must be cooled to below that temperature to operate in a qubit measurement device. Also, the bronze (or copper or other metal) powder must be cooled to some low temperature below which the absorption properties of the metal powder do not change. Because of this cooling requirement, metal powder would likely be unacceptable. There are two reasons for this unacceptability. The first, which can be seen from FIG. 2, is that the particles are irregularly shaped and have a surface characterized by voids. Therefore, even if the powder were tightly packed, only a very small percentage of each particle's surface area would actually contact the surface of its adjacent particles. As a result, the powder would have poor thermal conduction. The second reason is that bronze (or copper or other metal) powder particles are covered with an oxide, which is generally a much poorer thermal conductor than non-oxidized metal. For these two reasons, if a user simply packed the space between the tube 12 and center conductor 14 with powder it would be very difficult, if not impossible, to adequately cool the center conductor 14 and the metal powder.

The above-described epoxy embodiment of the binder in the mixture 16 overcomes this problem because, if picked as specified above, such an epoxy is a reasonable thermal conductor and it fills the voids between the metal particles. The described epoxy therefore provides a medium that allows heat to pass from the warm powder and center conductor 14 to the outer tube 12.

Guidance for selecting the material for the binder of the metal powder/binder mixture 16 is provided by the illustrative example of the FIG. 1 filter, having brass as the material for the outer tube 12. The thermal contraction of type "2850 FT" is much closer to brass than is "1266 A/B." Stated with more particularity, the thermal contraction of brass is about 38 parts per ten thousand parts per degree Celsius. The thermal contraction of type "2850 FT" is approximately 51 parts per ten thousand parts per degree Celsius. Although this is not exactly equal to the thermal contraction of brass, it was close enough that, at least for filter of the dimensions described herein, thermally induced stresses did not cause the center conductor 14 to break, which would in turn cause failure of the filter. On the other hand, the thermal contraction of type "1266 A/B," if used as a stand-alone binder in the mixture 16, is approximately 115 parts per ten thousand parts per degree Celsius. The difference between this number and the thermal contraction of brass is such that thermally induced stress would break the center conductor 14. Another reason that a binder having predominantly type "2850 FT" is preferable is that, at low temperatures, the thermal conduction of type "2850 FT" is better than type "1266 A/B" by a factor of approximately 100.

An observed illustration of the reason for matching the thermal conduction and thermal contraction of the binder, e.g., epoxy, of the mixture 16 with that of the outer tube 12 is that, when prototypes using only type "1266 A/B" were cooled, the mixture 16 would shrink at a rate different than the outer tube 12 and/or center conductor 14, thereby causing the center conductor 14 to break.

Referring to FIG. 1, values for the LT, DT, ID, WT and CD dimensions, selected in view of commercially available materials, physical constraints such as, for example, ease of gripping, pulling and soldering the center conductor 14 as described below, and in view of Equation No. 1 of this disclosure. For example, the present inventors constructed prototypes having LT, DT, ID, and WT dimensions based on a center conductor diameter CD of 0.005 inches. That CD value was a starting point because wire having that diameter was readily available, convenient to work with, and compatible with the particular SSMA connectors (for the first connector 22 and second connector 26) and soldering equipment at hand. 50Ω was picked as an example target characteristic impedance. A value of the Equation No. 1 parameter K was estimated by referencing the materials and consistency of the metal powder/binder material 16 in standard materials handbooks and in other materials references readily known or available to persons skilled in the art. Then, based on the estimated value of K, the following example dimensions were selected: LT=six inches, DT=0.125 inches, ID=0.095 inches, WT=0.015 inches and CD=0.005 inches. As described further below, after these dimensions are chosen and the filter is constructed, differences between the measured impedance and the desired impedance can be corrected by selecting a different outer tube 12 inner diameter ID, a different center conductor 14 diameter CD, or by fine tuning the material 16, e.g., changing the relative percentage of metal powder and epoxy, and thereby changing the actual value of K.

Referring again to FIG. 1, an example assembly procedure of a filter such as the example filter 10 will now be described. The described example assembly process is straightforward. For purposes of this example, it is assumed that the outer tube 12, center conductor 14, connector block 18, connector tube 20, first connector 22 and second connector 26 are separate pieces. It will be understood that the described assembly process is not the only method or process for assembling a filter according to the present invention. Further, it will be understood that if alternative structures are used such as, for example, a connector block 18 having an integral connector (not shown) functioning like connector 22, then a corresponding modification of the described assembly procedure would be required, which can be readily understood by a person of ordinary skill in the art.

An important criterion in the assembly is to align and maintain alignment of the center conductor 14 in relation to the outer tube 12, and in relation to the center conductor 26A of the second connector. The structure of the example filter 10 significantly assists with these alignment tasks.

First, a length of the center conductor 14 was selected such that if the filter 10 were assembled as shown in FIG. 1, the conductor 14 would extend in a rightward direction, from location 26B all the way through the outer tube 12, over the connector 22B, and protrude out (not shown) from the second clearance hole 18C of the block connector 18. The described protruding portion of the center conductor 14 is not shown in FIG. 1, because FIG. 1 shows the filter 10 after that protruding portion of the center conductor 14 was clipped, such that the conductor 14 ends at the center conductor surface 22B of the first connector 22.

Next, after selecting the length of wire for the center conductor 14, one end of that wire 14 was soldered to the end surface 26B of the center pin 26A of the second connector 26, which for this example is an SSMA connector. This soldering was done prior to the second connector 26 being soldered to the connector adapter tube 20. This soldering must be carefully performed, because it is important that the wire 14 abuts 26B to be aligned on center, as closely as possible. If the alignment is not on-center, the result is an impedance mismatch at the abutment between the end of the wire 14 and the surface 26B. The numerical tolerance for the alignment therefore translates into the tolerance of an impedance mismatch. An example tolerance, which relates to the above-described dimensions used for the described examples, is the center conductor 14 being from approximately 0.003 inches to 0.005 inches of true center of the surface 26B.

The present inventors developed a soldering technique that is sufficient to practice the described invention. The technique is to use an optical microscope, view the abutment of the center conductor 14 and the surfaced 26B from at least one direction perpendicular to the longitudinal axis of the center conductor 14. When adequate alignment is observed, solder the center conduct 14 to the surface 26B. Next, inspect the soldered joint from the two directions and, if the wire 14 does not look properly centered on 26B after soldering, remove the solder and repeat the operation. Using ordinary soldering skills, the number of repeats (if any) required to attain a centered connection is reasonable.

It should be noted that, ultimately, a time domain reflectometer ("TDR") test identifies how well the assembly has occurred. As known by persons of ordinary skill in the art, the flatness of the TDR trace shows the characteristics of all connections in the completed filter 10, including any misalignments. As also known in the art, the target flatness of the TDR trace is determined by the particular application the filter will be used for.

After the above-describe soldering of one end of the center conductor 14 to the end surface 26B of the center conductor 26A of the connector 26, the other end of the conductor 14 was inserted into the connector adaptor 20 until the second connector 26 extended into the connector receiving bore (not labeled) of the connector adaptor 20. The second connector 26 was then soldered to the connector receiving bore (not numbered) of the connector adaptor 20.

Next, the outer tube 12 was inserted into outer tube receiving bore 20A of the connector adaptor 20 and soldered. Alternatively, the outer tube 12 could have been soldered to the outer tube receiving bore 20A of the connector adaptor 20 prior to soldering the second connector 26 to the connector adaptor 20.

Next, without any specific requirement as to order, the first connector 22 is inserted into the connector receiving bore (not specifically shown) of the connector block 18, and soldered in place. Assuming that the outer tube 12 has already been inserted into the outer tube receiving bore 20A of the adaptor connector 20, as described above, the right end of the outer tube 12 is inserted in the outer tube receiving bore 18A of the connector block 18 and is soldered in place. The center conductor 14 then extends through the second clearance hole 18C of the connector block 18.

Next, the portion (not shown) of the center conductor 14 extending out from the second clearance hole 18C was gripped with a pair of pliers and pulled tightly across the top 22B of the center pin 22A of the first connector 22 and soldered. After the solder set, the tension established by pulling the center conductor 14 remained, thereby urging the center conductor to follow a substantially straight line, from its solder connection to surface 26B to its solder connection to surface 22B, thus minimizing sagging of the center conductor 14 between those two connection points. The portion of the center conductor 14 extending rightward from its solder connection to surface 22B was then clipped.

Preferably, if the filter 10 is to be used at low temperatures such as those relating to qubit measurements, all solder joints are made using non-superconducting silver/tin solder. The reason is that standard lead tin soft solder will go superconducting at such temperatures, which may create a potential for a problem where two parts are joined with solder. The potential problem is that since the superconducting solder does not transport heat well, the two parts are no longer in good thermal contact. Also, the silver/tin solder is stronger. Therefore the solder joints holding the two ends of the center conductor 14 (namely the joint at one end between the conductor 14 and the end surface 26B of the second connector, and the joint at the other end between the center conductor 14 and the top surface 22B of the first connector 22) can maintain sufficient tension on the center conductor 14 such that sagging prior to injection with the metal powder/binder mixture 16 is tolerable.

Regarding guidelines for the tension on the center conductor 14, these are similar to the guideline for alignment between the center conductor 14 and the end 26B of the center conductor 26A of the second connector 26; tension reduces gravity sag, because sag, like misalignment in the center conductor 14 results is unwanted impedance variations. The desired straightness of the center conductor will depend on how flat of a TDR test result the user desires. If the tension is too low, such that there is too much sag in the center conductor 14, then the TDR trace will have a dip in the middle. Stated differently, the requirement of the particular application determines how much sag can be tolerated. For the example application of qubit measurement, variations of alignment and sag of the order of approximately 0.003 inches were acceptable, i.e., yielded acceptable impedance characteristics as indicated by TDR measurements.

The final step was injecting the metal powder/binder mixture 16 into the second clearance hole 18C until it emerged from the small vent hole 28.

Example applications of the filter described herein include quantum computing. A reason is that in many qubit experiments one or more electrical lines transmit pulses having very fast rise times. A typical system for measuring qubits is designed to be 50Ω everywhere, since this is the characteristic impedance of standard measurement equipment and, as known in the relevant arts, impedance mismatches will affect the shaped pulse. The room temperature electronics are a source of noise, and therefore these fast lines will benefit from the presently described metal powder filters located at low temperatures. Therefore, the criteria for this example application of the filter of this invention is that it be a low pass 50Ω characteristic impedance filter. A filter according to the present invention meets these requirements, is easy to fabricate and, equally important, by simply using a high thermal conductivity epoxy binder, is easy to heat sink.

Five illustrative examples will now be described to assist persons of ordinary skill in the art in forming an understanding of the invention. The five examples are labeled "F1," F2," "F3, "F4" and "F5," and their defining parameters are listed in Table I below. The Z (Ω) and A(dB) values are those exhibited at T=four degrees Kelvin.

TABLE I

| Filter | Metal | % metal (wt) | Z (Ω) at 10 GHz | A (dB) at 10 GHz |
|---|---|---|---|---|
| F1 | copper | 70 | 53 | −26 |
| F2 | Bronze | 50 | 71 | −30 |
| F3 | Bronze | 69 | 64 | −46 |
| F4 | Bronze | 75 | 59 | −73 |
| F5 | Bronze | 78 | 54 | −90 |

Figure 3:
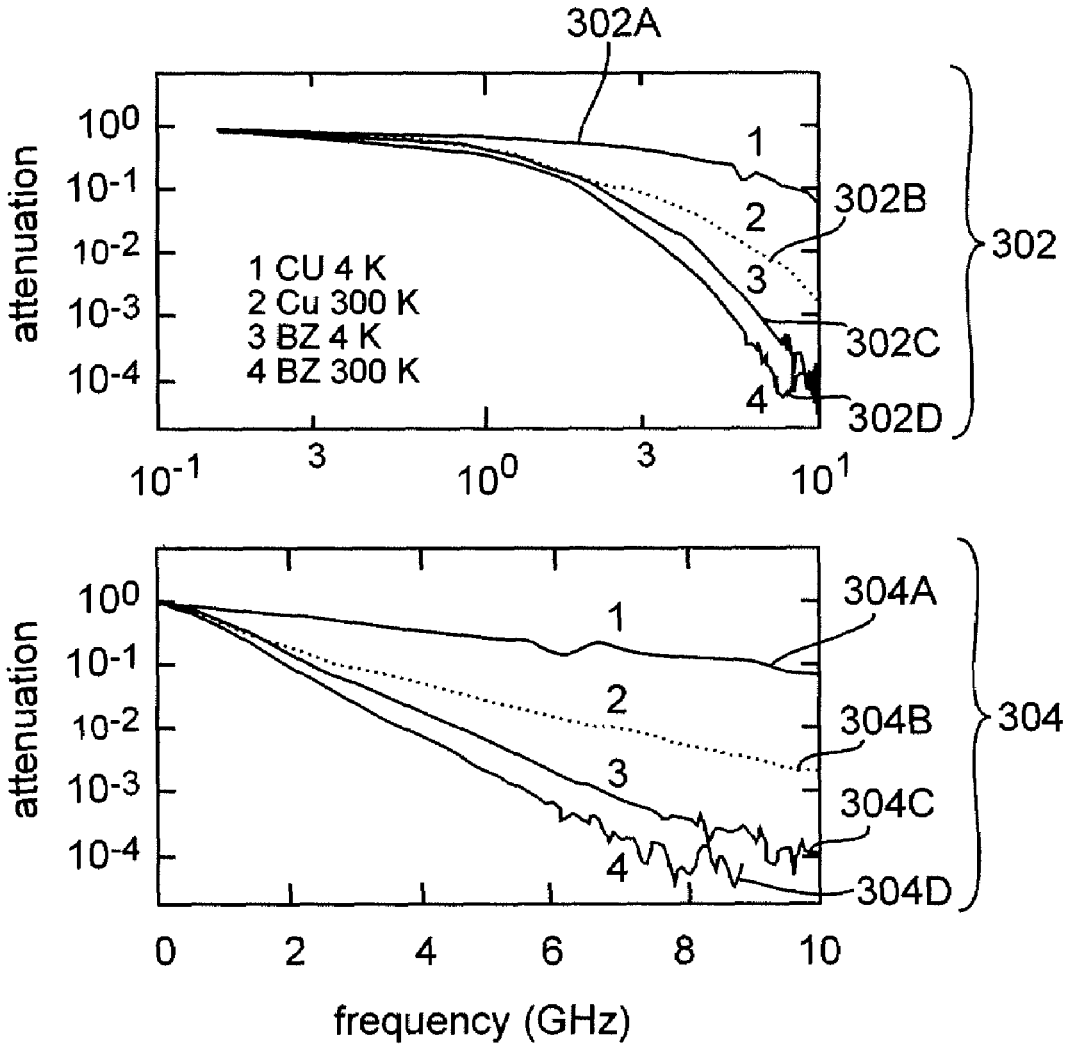
FIG. 3 shows a semi-log and a log-log plot of observed attenuation versus frequency of two example filters according to the invention, as seen at two temperatures.

Filter F1 was made using Aremco™ 1-5 μm Cu powder. The other four example filters F2-F5 were made using bronze powder. Referring to FIG. 3, graph 302 shows the observed attenuation data, of attenuation versus frequency with a logarithmic frequency scale, on filters F1 and F5 measured at temperature T of 300 degrees and 4 degrees Kelvin. Graph line 302A is the attenuation of filter F1 observed at T=4 degrees Kelvin, and graph line 302B is the attenuation of the same filter F1 observed at T=300 degrees Kelvin. Graph line 302C is the attenuation of filter F5 observed at T=4 degrees Kelvin, and graph line 302D is the attenuation of the same filter F5 observed at T=300 degrees Kelvin.

The temperature of 4 degrees Kelvin was chosen because an example application for the filters of this invention is in measuring qubits at temperature of 4 degrees Kelvin or lower. The F1 filter has 70% copper powder, and the F5 filter has 78% bronze powder. Attenuation A=Vout/Vin and attenuation A(dB)=20 log(Vout/Vin). The attenuation can be measured using, for example, an Agilent™ model "8729" network analyzer or equivalent. The noise floor of this "8729" example network analyzer, however, is such that attenuation A=0.0001 or A(dB)=−80 dB is effectively the maximum measurable attenuation. This is reflected by graph line 302D of graph 302, showing a flattening of attenuation A or A(dB) at that value.

Graph 304 shows the same observed data as Graph 302, but using a linear frequency scale.

Figure 4:
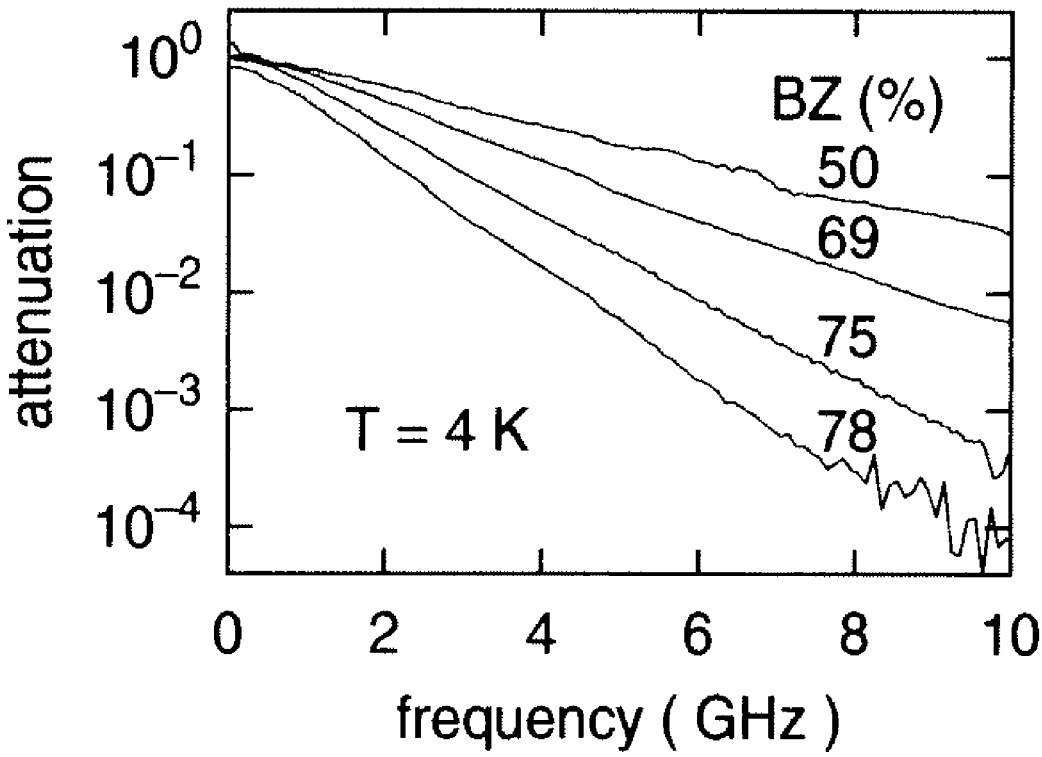
FIG. 4 shows a plot of observed attenuation versus frequency at 4° Kelvin of four example filters structured according to the invention.

FIG. 4 shows attenuation measurements on example filters F2, F3, F4 and F5 listed in Table I. Graph lines 402A, 402B, 402C and 402D are the measurements of example filters F2, F3, F4 and F5, respectively. Referring to Table I, each of these four prototype filters F2, F3, F4 and F5 has a particular percentage of bronze powder that is different than the other three. As expected at a fixed frequency, attenuation A increases as the percentage of bronze powder is increased. Stated with greater specificity, the attenuation mechanism of the present filter is by losing energy to the metal powder. Therefore, the more metal powder close to the center conductor 14 the more energy loss. So, increasing the amount of metal powder and reducing the amount of filler (the epoxy) in the mixture 16 increases the energy loss and, hence, increases the attenuation.

When constructing filters according to this invention, test results such as shown in FIGS. 3 and 4 may show an attenuation that does not meet a specific target value at certain frequencies. For example, a natural operating frequency of qubits can be near 2 GHz. Referring to Table I and FIGS. 3 and 4, if a filter such as F5 is used, which is 78% bronze, the attenuation at this example frequency of interest is 20 dB. If more attenuation is needed, there are at least two variations of the described embodiments that will suffice. One is to increase the percentage of bronze powder, which may require readily determined reformulation of the binder, e.g., epoxy, to have adequate viscosity for injection. Another solution, which may be easier because of observed difficulties, at least with the epoxies described herein, in attaining a percentage of bronze higher than 78%, is to gang two of the filters in series.

Figure 5:
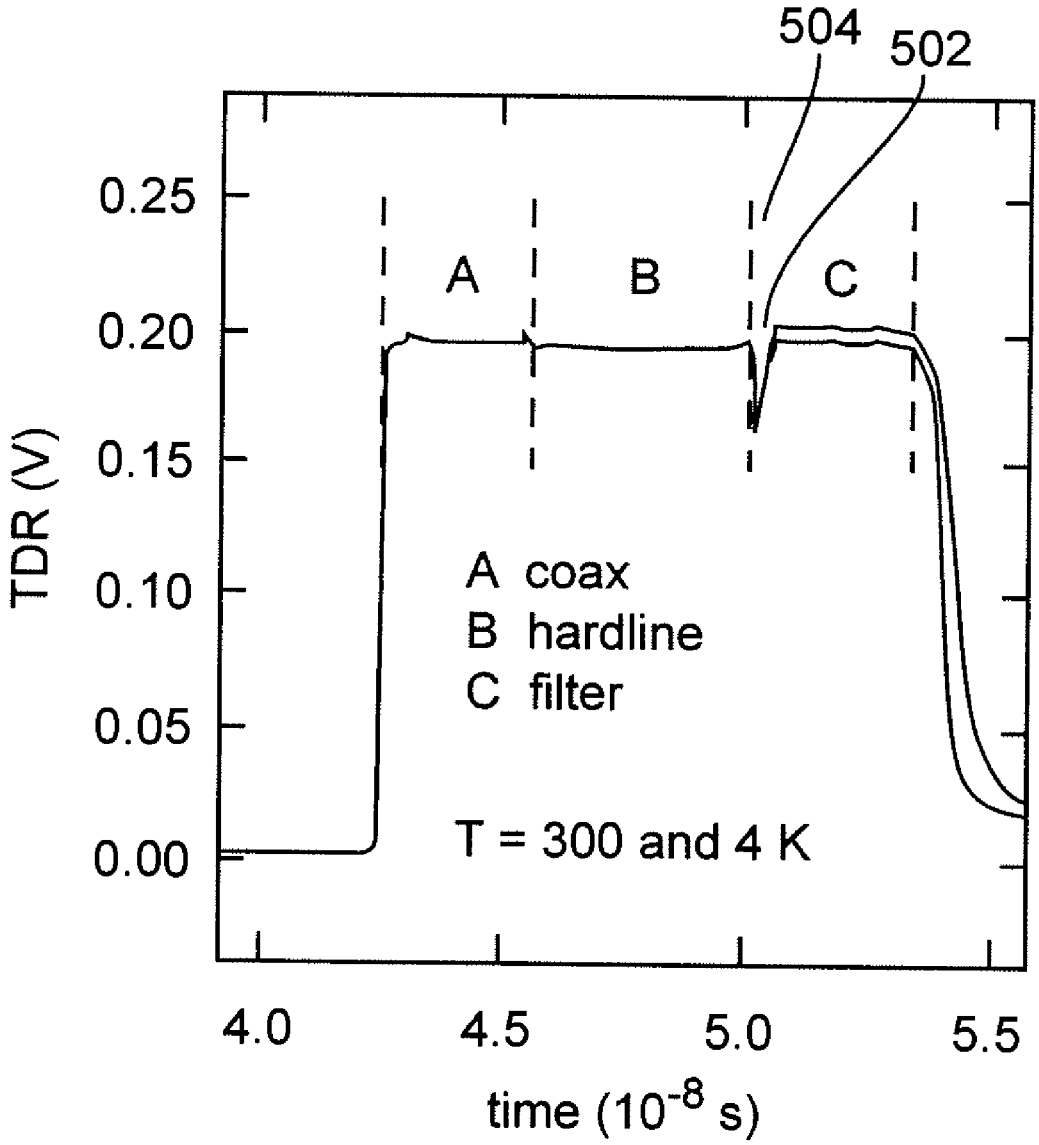
FIG. 5 shows a plot of observed time-domain reflectometer ("TDR") tests of an apparatus including a particular constructed example filter according to the invention.

FIG. 5 shows observed time domain reflectometer (TDR) data on the filter F5 described in Table I, operating at 4 degrees Kelvin. The FIG. 5 measurements were made using a Hewlett-Packard 54750 digitizing oscilloscope and a Hewlett-Packard™ model number 54753 A TDR module. This instrument is suitable for measurements in the frequency range of 50 MHz to 20 GHz.

With continuing reference to FIG. 5, the three time regions of interest, labeled A, B and C, each corresponding to a different part of the measurement hookup (not shown). Region A is a 12 inch length of coax used in the hookup, region B is an 18 inch semi-rigid hardline in the hookup, which is a transition piece between room and low temperature, and region C is the FIG. 1 filter according to Table I being measured. The filter F5 used in the hookup for the FIG. 5 TDR measurement was terminated by a ground cap (not shown). The squiggles labeled 502 near the vertical dashed lines 504 are due to imperfections in the connectors connecting the filter to the hardline.

Referring to FIG. 5, impedance measurements and methods for fine-tuning the impedance of the filters of this invention will now be described.

The impedance of the filter is calculated using the formula:

$$\frac{E_0}{E} = \frac{Z - Z_0}{Z + Z_0}, \qquad \text{(Eq. 2)}$$

where $E_0$ is the voltage level of the known 50Ω region, E is the voltage level of the filter region, $Z_0$ is 50Ω and Z is the filter impedance. Referring to FIG. 5, FIG. 5 the y axis is a measured voltage. Regions A and B are known to be 50 ohm regions. It can be seen that Eo is approximately 0.2 V. Using this formula and the data shown in FIG. 5, the present inventors observed find that, for the filter F5, Z=52Ω at 300 degrees Kelvin and Z=54Ω at 4 degrees Kelvin.

Since the example application of the invention was measuring qubits at temperatures below 4 degrees Kelvin, and the ideal impedance was 50Ω for purposes of minimizing mismatches, the observed impedance of 54Ω could be a matter for concern. Whether or not such a difference between the actual impedance and the desired impedance is a concern is a matter that is specific to the particular application. If it is a concern, a convenient, practical solution is to fine tune the filter impedance. Guidance for the fine tuning is the following well known formula for the characteristic impedance of a coaxial line, presented as Equation No. 1 in this description:

$$Z = \frac{138}{K^{1/2}} \log(b/a),$$

where K is the effective dielectric constant of the metal powder/binder mixture 16, the variable a is the diameter CD of the center conductor 14, and variable b is the inside diameter ID of the outer conducting tube 12.

Using Eq. 1, the inventors found that Z could be reduced from 54Ω to 50Ω simply by reducing the inner diameter ID of the outer tube 12 (which for this example was a brass tube) from 0.095 inches to 0.077 inches.

Figure 6:
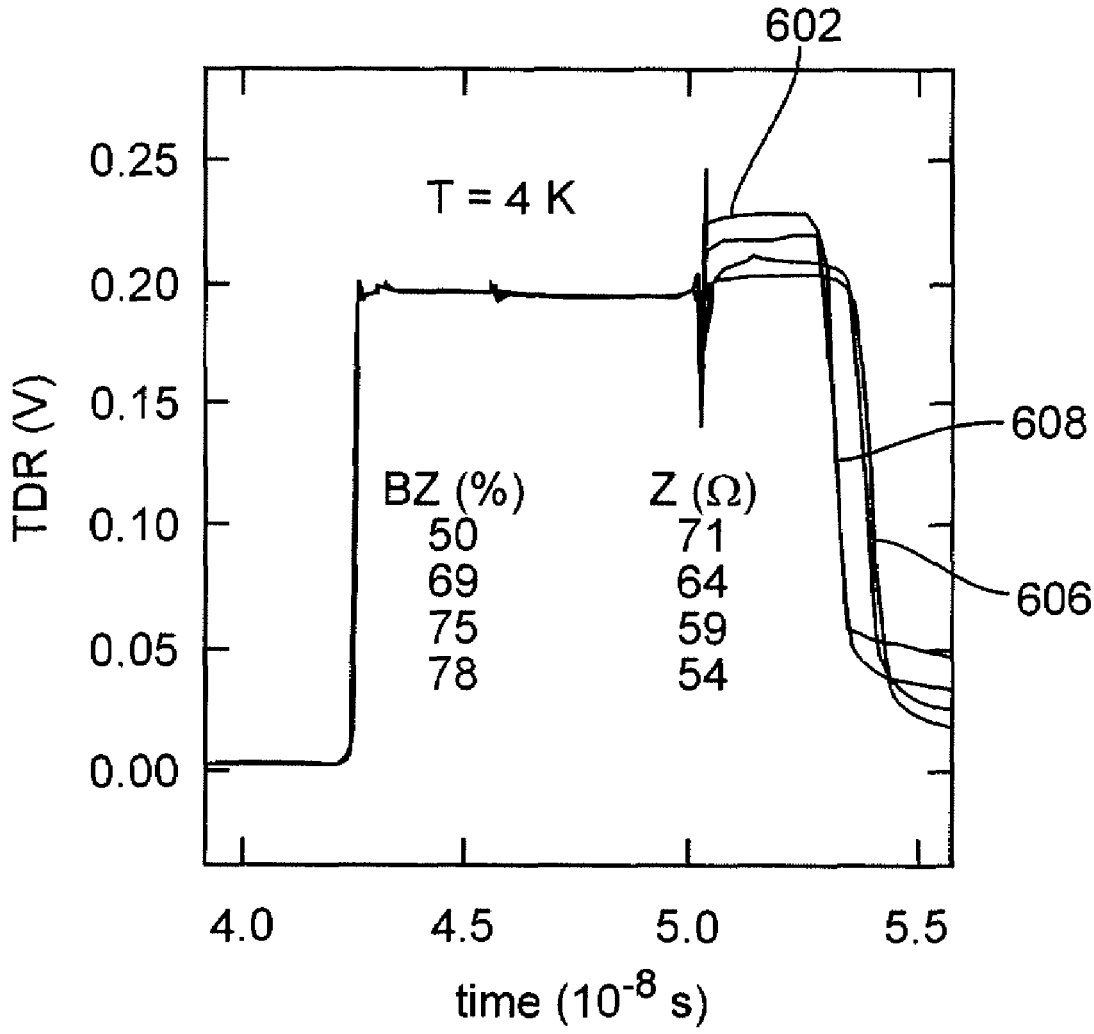
FIG. 6 shows a plot of observed TDR tests of the four example filters having observed frequency characteristics shown in FIG. 5.

FIG. 6 shows TDR measurements on prototype filters F2, F3, F4 and F5 at a temperature T=4 degrees Kelvin. It can be seen that the lower two traces 606 drop at a different place in time than the upper two traces 608. The reason was not the filter itself, it was due to the laboratory set-up they used a different adaptor/ground cap.

The measurements in FIG. 6 again show that the characteristic impedance of the filter drops as the percentage of bronze powder increases. As previously stated, if 50Ω is the target, a percentage slightly larger than 78% would help get closer to our 50Ω goal. However, as also discussed, difficulties may be encountered in achieving metal powder percentages higher than approximately 78%. The alternative solution to the impedance issue would therefore be to simply use an outer tube 12 with a smaller inside diameter ID.

While certain embodiments and features of the invention have been illustrated and described herein, many modifications, substitutions, changes, and equivalents will occur to those of ordinary skill in the art. It is therefore to be understood that the appended claims are intended to cover all such modifications and changes as fall within the spirit of the invention.

We hereby claim:

1. A coaxial filter comprising:

a tubular outer conductor, having inner diameter, extending a given length from a first end to a second end distal from said first end, said inner diameter being in a direction perpendicular to a longitudinal center axis;

an inner conductor arranged to extend substantially parallel to and collinear with said longitudinal center axis, such that an outer surface of said inner conductor and an inner surface of said tubular outer conductor define a cylindrical volume; and a filler material comprising a metal powder, said metal powder including a plurality of metallic particles, disposed in said cylindrical volume, wherein the inner diameter of the outer tubular conductor, the filler material, and the diameter of the inner conductor are constituted, structured and arranged to provide a characteristic impedance Z according to the formula $$Z = \frac{138}{K^{1/2}} \log(b/a),$$

where K is the dielectric constant of said filler material, a is said diameter of the inner conductor, and b is said inside diameter of the outer tubular conductor.

2. The filter of claim 1, wherein the said filler material further comprises a binder substantially filling spaces among said metallic particles.

3. The filter of claim 2, wherein said binder includes a thermally conducting epoxy having a high thermal conductivity.

4. The filter of claim 3, wherein said binder further includes a mixture of a viscosity control epoxy having a low viscosity prior to setting.

5. The filter of claim 1, wherein said metal powder includes at least one of brass and copper.

6. The filter of claim 1, wherein the inner conductor comprises a superconducting metal.

7. The filter of claim 1, wherein said metallic particles include a metal oxide portion.

8. The filter of claim 1, wherein Z is approximately 50Ω at less than 20 degrees Kelvin.

9. The filter of claim 1, wherein the inner diameter of the outer tubular conductor, the filler material, and the diameter of the inner conductor constituted, structured and arranged to provide a cut-of frequency of less than 500 MHz and an attenuation greater than −70 dB at approximately 10 GHz.

10. A method for making a low pass coaxial filter, comprising:

providing a tubular outer conducting member, having an inner surface defining a cylindrical volume extending along a longitudinal center axis;

arranging an inner conductor to extend inside of said tubular outer conducting in an alignment direction substantially collinear with said longitudinal center axis; and filling said cylindrical volume between an outer surface of said inner conductor and said inner surface of said outer tubular member with a filler material comprising a metal powder, wherein said outer tubular conducting member has an inner diameter b, said inner conductor has an outside diameter a, and said filler material has a dielectric constant K, and wherein a, b, and K are selected to achieve a given a characteristic impedance Z according to the formula $$Z = \frac{138}{K^{1/2}} \log(b/a).$$

11. The method of claim 9, wherein said arranging includes:

providing a first coaxial connector having a center conductor;

connecting one end of said inner conductor to said center conductor of said first coaxial connector, connecting said first coaxial connector to one end of said outer tubular conducting member;

providing a second coaxial connector having a center conductor;

connecting said second coaxial connector to said other end of said outer tubular conducting member; and connecting the other end of said inner conductor to said center conductor of said second coaxial connector.

12. The method of claim 11, wherein said arranging is carried out such that said inner conductor is secured under tension, in said alignment direction, between said center conductor of said first coaxial connector and said center conductor of said second coaxial connector.

13. The method of claim 10 wherein said filling includes:

mixing said metal powder in a liquid binder that sets into a solid after a given time, to form a liquid mixture;

injecting said liquid mixture into said volume between said inner conductor and said outer tubular conducting member; and allowing said liquid mixture to set for said given time to form said filler material comprising a metal powder.

14. The method of claim 11, wherein said first coaxial connector, said outer tubular conducting member and said second coaxial connector are constructed and arranged such that upon connecting said second coaxial connector to said other end of said outer tubular conducting member an injection port is proximal to one of said center conductor of said first coaxial connector and said center conductor of said second coaxial connector, and a vent port is proximal to the other of said center conductor of said first coaxial connector and said center conductor of said second coaxial connector, and wherein said filling includes:

mixing said metal powder in a liquid binder that sets into a solid after a given time, to form a liquid mixture;

injecting said liquid mixture through said injection port into said volume between said inner conductor and said outer tubular conducting member, such that said liquid mixture fills said volume and forces matter in said volume other than said liquid mixture through said vent port; and allowing said liquid mixture to set for said given time into said filler material comprising a metal powder.

* * * * *